US008989894B2

(12) United States Patent
Tenberg, Jr.

(10) Patent No.: US 8,989,894 B2
(45) Date of Patent: Mar. 24, 2015

(54) SYSTEM AND METHOD FOR DISPENSING ICE

(76) Inventor: David W. Tenberg, Jr., Waco, TX (US)

( * ) Notice: Subject to any disclaimer, the term of this patent is extended or adjusted under 35 U.S.C. 154(b) by 597 days.

(21) Appl. No.: 13/214,017

(22) Filed: Aug. 19, 2011

(65) Prior Publication Data

US 2013/0042634 A1 Feb. 21, 2013

(51) Int. Cl.
*G06F 17/00* (2006.01)
*F25C 5/18* (2006.01)

(52) U.S. Cl.
CPC ..... *F25C 5/18* (2013.01)
USPC ..... 700/237; 62/66; 62/132; 62/344; 700/231

(58) Field of Classification Search
CPC ..... F25C 5/002; F25C 5/005; F25C 2400/02; F25C 2305/00; B67D 3/0006
USPC ..... 62/66, 344, 132; 700/231, 237
See application file for complete search history.

(56) References Cited

U.S. PATENT DOCUMENTS 4,049,161 A 9/1977 Kohl
5,413,249 A 5/1995 Chigira
5,586,446 A 12/1996 Torimitsu
6,112,539 A 9/2000 Colberg
6,115,649 A 9/2000 Sakata
6,186,358 B1 2/2001 Peteraf
6,742,673 B2 6/2004 Credle, Jr. et al.
6,751,525 B1 * 6/2004 Crisp, III ..... 700/241
6,932,124 B2 8/2005 Dalton et al.
6,968,876 B2 * 11/2005 Yacko et al. ..... 141/361
6,986,263 B2 * 1/2006 Crisp, III ..... 62/389
7,032,779 B2 * 4/2006 Crisp et al. ..... 222/129.1
7,032,780 B2 * 4/2006 Crisp, III ..... 222/129.1
7,076,329 B1 7/2006 Kolls
7,104,291 B2 9/2006 Dalton et al.
7,389,919 B2 6/2008 Walker et al.
7,428,824 B1 9/2008 Malachowsky et al.
7,464,867 B1 12/2008 Kolls
7,630,939 B1 12/2009 Kolls
7,681,408 B2 3/2010 Hobson et al.
7,693,602 B1 4/2010 Kolls
7,735,527 B2 6/2010 Dunn
7,756,604 B1 * 7/2010 Davis et al. ..... 700/240
7,865,430 B1 1/2011 Kolls
2005/0098625 A1 5/2005 Walker et al.
2008/0040211 A1 * 2/2008 Walker et al. ..... 705/14
2008/0073373 A1 3/2008 Vicentin
2008/0126261 A1 5/2008 Lovett
2009/0055281 A1 2/2009 DeMedio et al.
2009/0306817 A1 12/2009 Antao et al.
2009/0306818 A1 12/2009 Slagley et al.
2009/0306819 A1 12/2009 Insolia et al.

(Continued)

FOREIGN PATENT DOCUMENTS

WO WO 2005111955 A1 * 11/2005

*Primary Examiner* — Mohammad M Ali
*Assistant Examiner* — Raheena Rehman

(57) ABSTRACT

An ice machine includes an insulated compartment to store ice, a dispenser having access to the insulated compartment to dispense ice from the insulated compartment, a card reader, and a controller in communication with the card reader and the dispenser. The controller stores permission settings including a public setting and a private setting. The controller is to receive a card number from the card reader. The controller is to determine whether to initiate ice dispensing using the dispenser based on the card number, the public setting and the private setting.

20 Claims, 7 Drawing Sheets

(56) References Cited

U.S. PATENT DOCUMENTS

| | | | |
|---|---|---|---|
| 2010/0070075 | A1 | 3/2010 | Chirnomas |
| 2010/0072221 | A1 | 3/2010 | Chirnomas |
| 2010/0161140 | A1 | 6/2010 | Doglioni Majer |
| 2010/0205985 | A1 | 8/2010 | Chang |
| 2010/0319806 | A1 | 12/2010 | Dalton et al. |
| 2011/0048045 | A1 | 3/2011 | An et al. |

* cited by examiner

SYSTEM AND METHOD FOR DISPENSING ICE

FIELD OF THE DISCLOSURE

This disclosure, in general, relates to systems and methods for automatically dispensing ice and, in particular, ice machines including a card reading system.

BACKGROUND

Consumers frequently purchase ice for use at parties and outings, such as picnics and boating trips. Some consumers also purchase ice instead of purchasing a refrigerator including an automatic ice maker. Much of the ice provided to consumers is prepackaged in bags and stored in freezers on-site at retail locations. However, such conventional supply methods are not cost-effective.

In particular, the ice supply chain is labor-intensive, requiring expensive labor for both packaging the ice and delivery. Moreover, such an ice supply chain provides waste as consumers often open the bags, deposit the ice in a cooler, and throw the bags away.

As such, an improved ice dispensing system would be desirable.

SUMMARY

In a first aspect, an ice machine includes an insulated compartment to store ice, a dispenser having access to the insulated compartment to dispense ice from the insulated compartment, a card reader, and a controller in communication with the card reader and the dispenser. The controller stores permission settings including a public setting and a private setting. The controller is to receive a card number associated with a card from the card reader. The controller is to determine whether to initiate ice dispensing using the dispenser based on the card number, the public setting and the private setting.

In a second aspect, a system includes an ice machine and a remote server. The ice machine includes an insulated compartment to store ice, a dispenser having access to the insulated compartment to dispense ice from the insulated compartment, a card reader, a communication circuitry, and a controller in communication with the card reader, the communication circuitry, and the dispenser. The controller stores permission settings including a public setting and a private setting. The controller is to receive a card number from the card reader. The controller is to provide the card number to a remote server and is to receive validation information from the remote server using the communication circuitry. The controller is to determine whether to initiate ice dispensing using the dispenser based on the validation information, the public setting, or the private setting. The remote server includes data storage associating the card number and the validation information. The system can include a plurality of the ice machines.

In a third aspect, a method of dispensing ice includes receiving permission settings at an ice machine, the permission settings including a public setting and a private setting; receiving an account code using a card reader at the ice machine; determining based on the account code, the public setting, or the private setting whether an account associated with the account code has permission to access the ice machine; and dispensing ice based on the determining.

In a fourth aspect, an ice machine includes an insulated compartment to store ice, a dispenser having access to the insulated compartment to dispense ice from the insulated compartment, a card reader, a communication circuitry to communicate with a remote device, and a controller in communication with the card reader, the dispenser, and the communication circuitry. The controller is to receive a card number from the card reader. The controller is to determine whether the card number is valid and active by communicating with the remote device using the communication circuitry. The controller is to initiate ice dispensing using the dispenser in response to the determining.

In a fifth aspect, a system includes an ice machine and a remote server. The ice machine includes an insulated compartment to store ice, a dispenser having access to the insulated compartment to dispense ice from the insulated compartment, a card reader, a communication circuitry to communicate with a remote device, and a controller in communication with the card reader, the dispenser, and the communication circuitry. The controller is to receive a card number from the card reader. The controller is to determine whether the card number is valid and active by communicating with the remote device using the communication circuitry. The controller is to initiate ice dispensing using the dispenser in response to the determining. The remote server includes data storage associating the card number and the validation information. The system can include a plurality of the ice machines.

In a sixth aspect, a method of dispensing ice includes receiving consumer information associated with a card number; establishing an account associated with the card number, the account defining a period of a subscription; receiving the card number from an ice machine; and providing validation data associated with the card number, the ice machine to dispense ice when the validation data indicates an account is valid and has not expired, the ice machine to dispense ice without debiting an account.

In a seventh aspect, a method of dispensing ice includes activating a card having a card number for a subscription period in response to receiving consumer information and dispensing ice in response to receiving the card number during the subscription period.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DESCRIPTION OF THE PREFERRED EMBODIMENT(S)

In an embodiment, an ice dispensing system includes a card having a card number associated with the card, an activation device for activating the card and for providing activation information associated with the card number to a remote server, the remote server, and ice machines in communication with the remote server. The ice machines can read the card. The card is activated at the activation station where a consumer establishes a subscription associated with the card. A subscription can be for a particular period of time such as a day, a week, a month or a year, and the subscription can be established to automatically renew for subsequent periods. The activation information including information about the subscription, the consumer, payment information, authorized location information, retail location data, or any combination thereof, can be provided to a remote device, such as the remote server accessible by the activation device and the ice machines. In an example, the subscription provides the consumer with access to ice from designated ice machines for the period of the subscription, for example, without debiting an account with each use.

In a further embodiment, a consumer can provide the card to the ice machine, which reads the card number and accesses the remote server to determine whether the card is active and optionally to determine whether the card has permission to access the particular ice machine. Upon determining that the card is valid, active, and has permissions to access ice at the particular location, the ice machine can dispense ice to the consumer. In particular, accessing ice using the card does not result in a debt of an account. Instead, the subscription can provide access to ice throughout subscription period.

Figure 1:
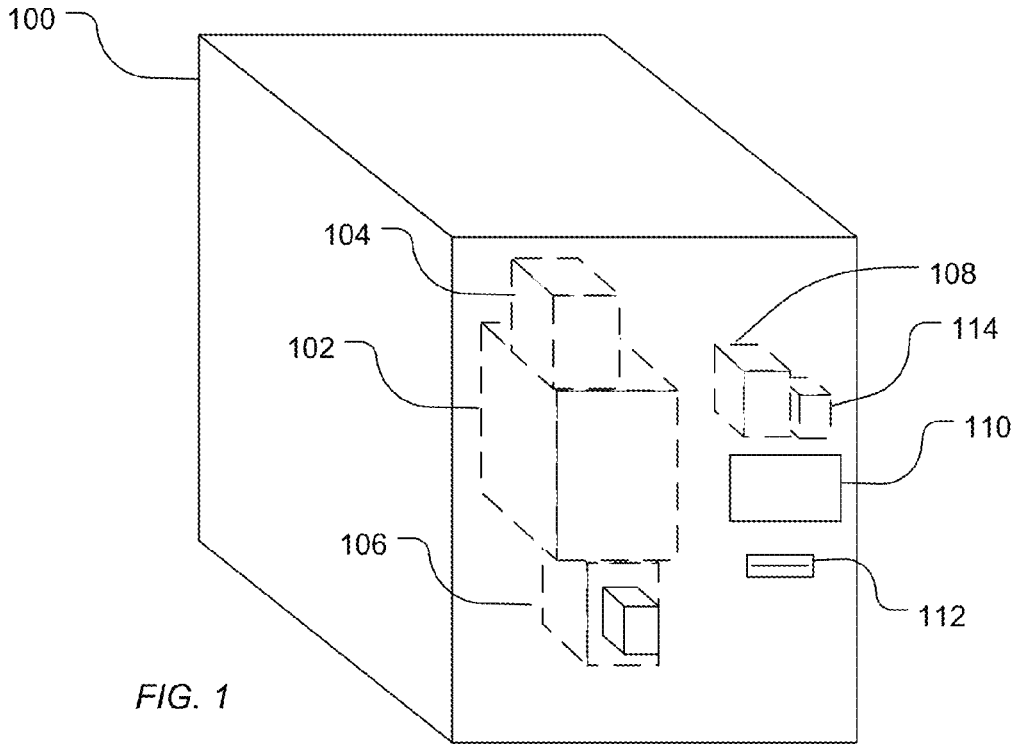
FIG. 1 includes an illustration of an exemplary ice machine.

As illustrated in FIG. 1, an ice machine 100 includes an insulated compartment 102 for storing ice. Ice can be provided from an icemaker 104 and dispensed to a consumer through a dispenser 106. A refrigeration system (not illustrated) can ensure that ice is made in the ice maker 104 and that ice remains cold in the insulated compartment 102. Further, the ice machine 100 can include a power supply or regulator (not illustrated) and a supply for water (not illustrated).

The ice maker 104 can provide ice in one or more of a variety of shapes. For example, the ice maker 104 can make ice in a crescent shape, a cylindrical shape, a cubic shape, a spherical shape, a curved shape or any combination thereof.

The dispenser 106 can provide a port or door that opens during dispensing. The dispenser can be gravity fed or can include a mechanism for conveying ice from the insulated compartment 102 to chute or outlet. For example, the dispenser 106 can include a screw mechanism to drive ice to a chute or outlet. In another example, the dispenser 106 can mechanically agitate the ice to facilitate dispensing through the chute or outlet. Optionally, the dispenser 106 can crush the ice.

Further, the ice machine 100 includes a controller 108, a card reader 112, a user interface 110, and a communication circuitry 114. For example, the controller 108 is in communication with card reader 112 to read a card number from a card provided to the card reader 112. In response to receiving the card number, the controller 108 can communicate with a remote system using the communication circuitry 114. Further, the controller 108 can be in communication with and can control the user interface 110. In response to determining that a card is valid, active, and has permission to be used at the location, the controller 108 can initiate dispensing ice using the dispenser 106. Further, the controller 108 can interact with the user using the user interface 110.

The user interface 110 can include a button and a display. The display can, for example, include an LED display. In another example, the user interface 110 can include a touch screen user interface. Alternatively, the user interface 110 can include displays and data entry devices, such as physical buttons and a pointing device. In a particular example, a user can select a button, implemented in a touch screen interface or a physical button, to initiate ice dispensing once the card been determined to be valid, active, and have the right permissions. A display can inform the user as to the status of the card or account and can provide instructions regarding operating the machine.

Figure 2:
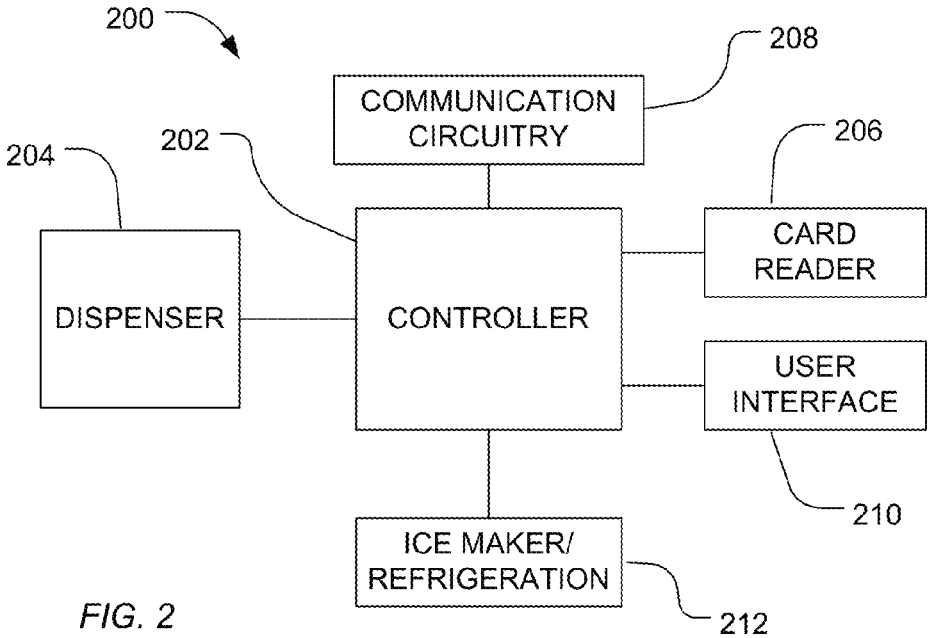
FIG. 2 includes an illustration of exemplary ice machine circuit diagram.

FIG. 2 includes a diagram illustrating circuitry of 200 of an ice machine. For example, the ice machine circuitry 200 can include a controller 202. The controller 202 can be in communication with the card reader 206 and the user interface 210. Further, the controller 202 is in communication with a communication circuitry 208. In addition, the controller 202 can be in communication with a dispenser 204 to initiate dispensing of ice. Optionally, the controller 202 can be in communication with circuitry associated with the ice maker or refrigeration system 212.

In particular, the controller 202 in communication with the card reader 206 can receive a card number of a card provided to the card reader 206. In conjunction with reading the card, the controller can serve to interact with the user by the user interface 210. In an example, the user interface 210 is a button with an LED display. In another example, the user interface 210 is a touchscreen interface. Alternatively, the user interface 210 can include one or more displays and entry devices, such as physical buttons and a pointing device. In particular, the user interface 210 includes a button either implemented as part of a touchscreen display or implemented as a separate physical button to initiate ice delivery through the dispenser 204. Once a card associated with an active account is provided, activation of the button can result in the dispensing device 204 for a set period of time or can result in a set amount of ice being dispensed, or ice can be dispensed while the button is depressed or activated.

In response to receiving a card number from the card reader 210, the controller 202 can communicate with a remote system using the communication circuitry 208. The communication circuitry 208 can include a wired or wireless interface. In an example, the communication circuitry 208 is a modem that can access a telephone system, such as a wired telephone system or a cellular telephone system. Alternatively, the communication circuitry 208 can access a wireless data network, such as a data network utilizing a protocol such as an IEEE 802.xx compliant protocol, including Blue-tooth®, Wi-Fi, WiMAX, a protocol in compliance with the International Mobile Telecommunications 1G, 2G, 3G, 3.xG, or 4G, or other wireless protocols. Further, the communication circuitry 208 can communicate with the remote server using Internet protocols to transfer data between the controller 202 and the remote server. In particular, the remote server can provide activation information to the controller 202 with which the controller 202 can determine whether the card is valid, active, or has permission to access ice at the ice machine.

In particular, the controller 202 can store location permission settings. The location permission setting can be compared with data associated with an account to determine whether a consumer has permission to dispense ice from a particular ice machine. The location permission settings can indicate whether the ice machine is a public ice machine accessible to most consumers with an account or is a private ice machine accessible only to those who are provide specific access. Optionally, the location permission settings can include a unique identifier associated with permissions of a private group of ice machines.

Figure 3:
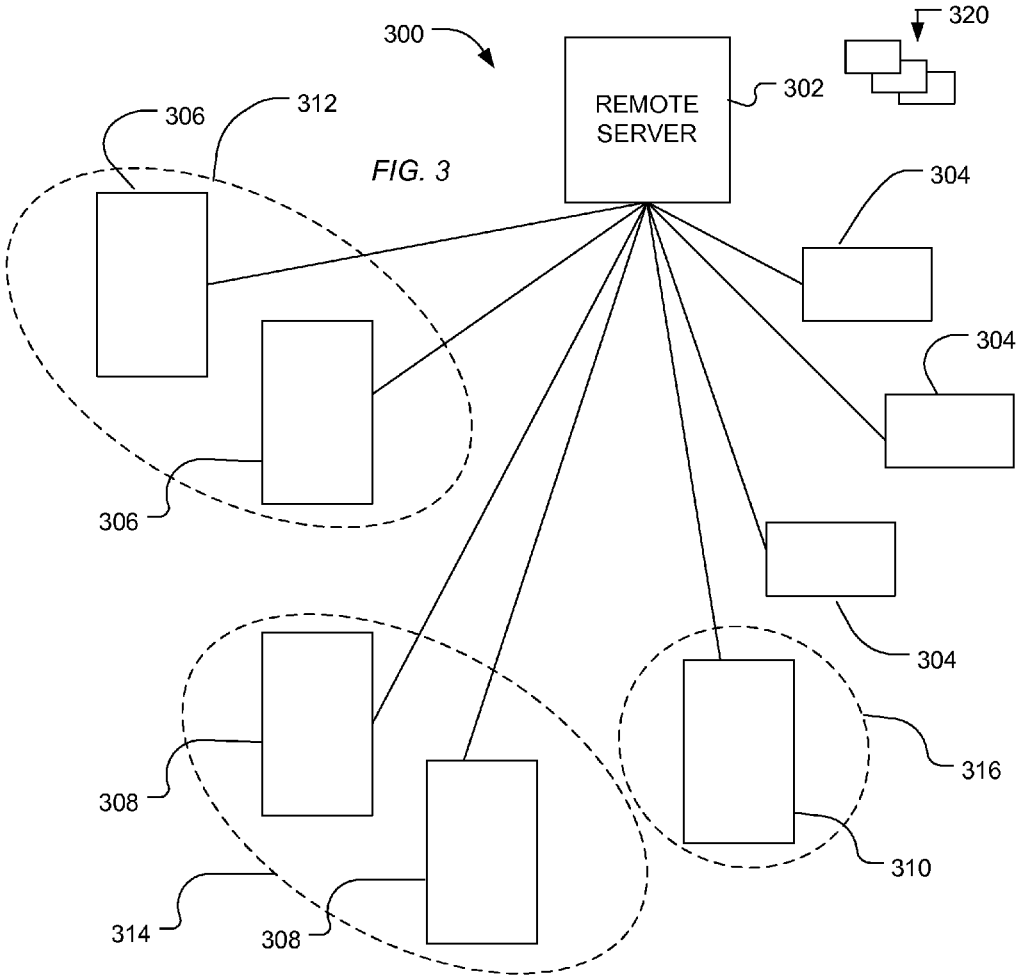
FIG. 3 includes an illustration of an exemplary system for authorizing ice dispensing.

Such an ice machine including such a circuitry can be utilized as part of an ice dispensing system. For example, FIG. 3 includes an illustration of an exemplary ice dispensing system 300. The ice dispensing system 300 includes a remote server 302 for storing activation information associated with activated cards 320. The cards 320 can include a magnetic strip, radio-frequency identification, or other data storage components for storing a card number in a computer-readable format. Optionally, the card can store a group number or an indicator as to whether the card can access public or third party ice machines. Alternatively, a group number or the indicator is store at the remote server 302 in association with the card number. In an example, the system 300 includes activation devices 304 through which a card 320 can be activated. The card 320 can be read by the activation device 304 and information about a consumer, payment, subscription type, authorized locations, retail information, or any combination thereof, can be entered at the activation device 304 and transferred to the remote server 302 for activating accounts associated with the card read by the activation device 304.

The consumer can provide the card to an ice machine, such as ice machines 306, 308, or 310. The ice machine can communicate with the remote server 302 to determine whether the card is valid, active, or has permission to access ice at the location of the ice machine. The remote server can provide a portion of the activation information, such as validation results, to the ice machine and the ice machine can determine whether to dispense ice based on the information or a portion thereof.

In a particular example, an account associated with the card can be provided with permission to access ice at a set 314 of public ice machines 308 provided at a variety of locations. For example, the set 314 of public ice machines 308 can be provided at retail locations, such as convenience stores, or at public venues, such as parks, recreation areas, sports complexes, and other public places. In another example, an account associated with card can be provided with permission to access ice at a private set 312 of ice machines 306. The private set 312 of ice machines 306 can, for example, be provided in residential complexes, country clubs, hotels, private golf courses, marinas, RV parks, camp grounds, grocery stores, food venues, fairs, or entertainment venues. Such accounts can also be provided with permission to access the public set 314 of ice machines 308. In a further example, an account associated with card can be provided with permission to access a set 316 of ice machines 310 and may not be provided permission to access the public set 314 of ice machines 308.

In such a manner, a retailer or group can provide members with access to ice at various locations. A retailer represents any vendor of goods or services. A group includes private and public retailers, clubs, venues, associations, unions, organizations, or other entities. In an example, retailers can provide patrons with access to ice through machines located at public locations. Such accounts can be restricted from accessing ice at private locations. Such public locations can include convenience stores, retail outlets, standalone machines adjacent to popular outdoor venues, such as parks, sports complexes, marinas, beaches, fishing piers, or any combination thereof.

Groups can optionally provide members with access to ice at public locations as well as at private locations. For example, a marina can provide patrons with access to ice at the marina and other marinas within a network of marinas, using a private set of ice machines not accessible to the public. The public can be restricted from accessing such ice at the marina. However, the marina can optionally provide its customers with the additional benefit of accessing a public set 314 of ice machines 308. In another example, a residential complex can provide its residents with access to ice machines within the complex. Optionally, the residents can be provided with the added benefit of being able to access ice at public locations, as well. Similarly, ice machines can be provided at RV parks or private campgrounds.

The remote server 302 can, for example, include a computational system accessible via a network, such as a global network, e.g., the Internet or a private network. The remote server can include a processor, a communication circuitry, and data storage. While the remote server 302 is illustrated as a single unit, one or more remote servers 302 can be used to implement the system 300. For example, an account server can interact with the activation devices 304 to establish accounts and activate cards, and a validation server can be used to interact with the ice machines to provide validation information. The one or more servers can interact with a common data storage. Alternatively, separate data storage can be provided for validation results to separate the validation data from account information, providing greater protection of personal data.

Figure 4:
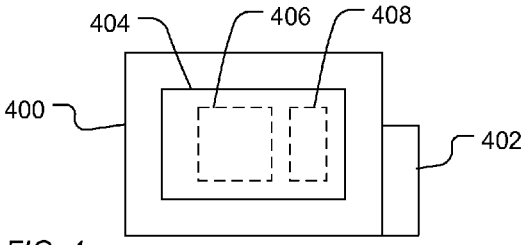
FIG. 4 includes an illustration of exemplary activation device.

As illustrated in FIG. 4, an exemplary activation device 400 includes a user interface 404 and a card reader 402. Internal to the activation device 400 is a processor 406 and a communication circuitry 408. The processor 406 can be in communication with the card reader 402, the user interface 404 and the communication circuitry 408. A card can be provided to the card reader 402, which provides a card number to the processor 406. Activation information is entered into the system using the user interface 404. The processor 406 controls the user interface 404 to provide an interactive interface for receiving activation information into the system. Such activation information and the associated card number can be provided by the processor 404 to the remote system through the communication circuitry 408.

In an example, the user interface 404 is a touchscreen user-interface. Alternatively, user-interface 404 can include one or more displays and one or more entry devices, such as keyboards and pointing devices.

The communication circuitry 408 can communicate using a wired or wireless connection. For example, the communication circuitry 408 can include a modem for communication using a telephone system. The telephone system can be a wired telephone system. In another example, the telephone system is a cellular telephone system. In a further example, the communication circuitry 408 can include a wireless communication circuitry for communication using wireless protocols, such as a protocol in compliance with IEEE 802.xx, such as Bluetooth®, Wi-Fi, WiMAX, a protocol in compliance with the International Mobile Telecommunications 1G, 2G, 3G, 3.xG, or 4G, or other protocols. In particular, the communication circuitry 408 can communicate using an Internet protocol to interact with the remote server. Once an account is established using the activation device 400, the card can be used at designated locations to access ice.

Figures 5, 7:
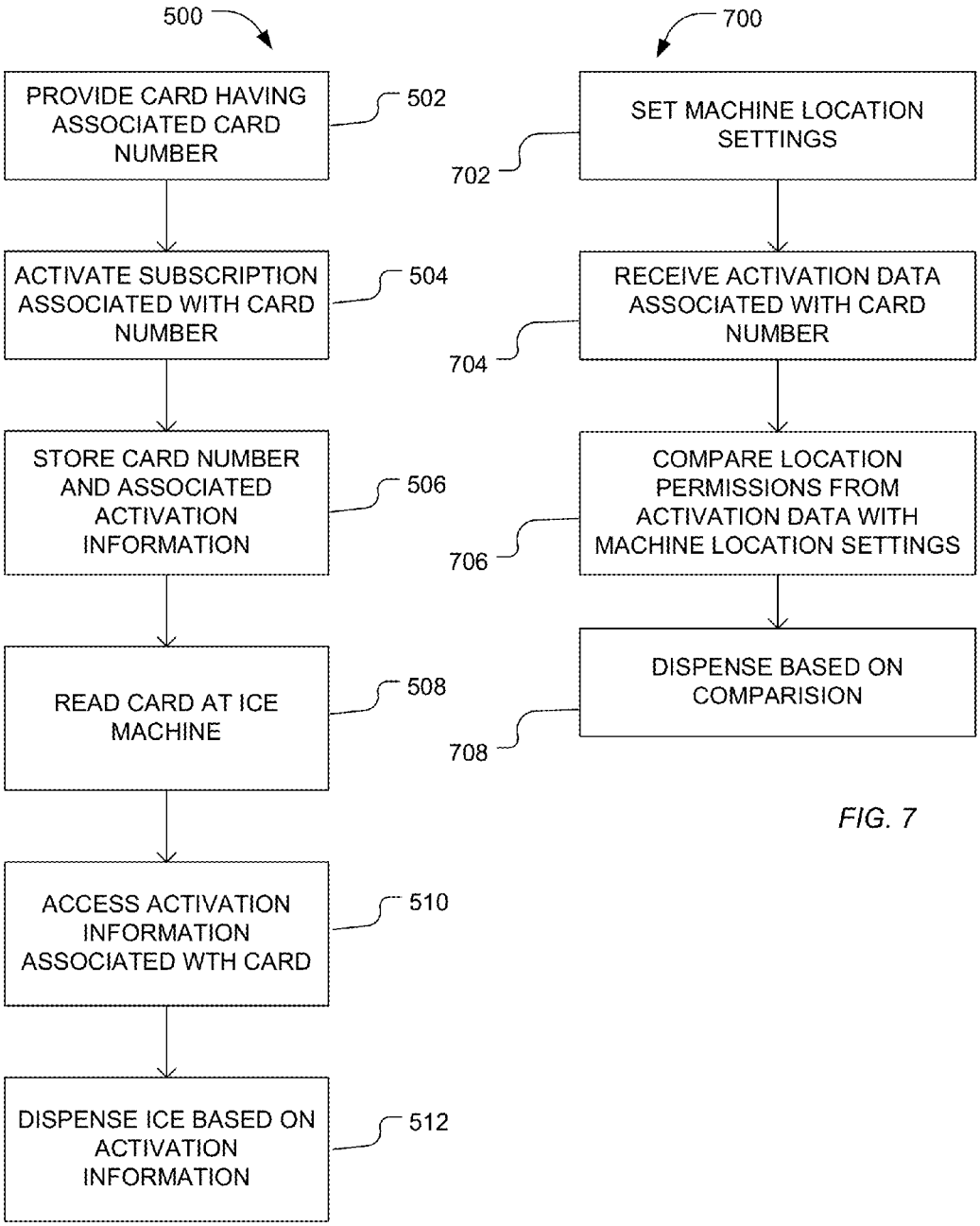
FIG. 5, FIG. 6, FIG. 7, and FIG. 8 include block diagram illustrations of exemplary methods useful in conjunction with dispensing ice.

In general, valid and active cards can access ice in a variety of locations. For example, in the method 500 illustrated in FIG. 5, a user can utilize a card to access dispensed ice. For example, as illustrated at 502, a consumer can be provided a card having an associated card number. The card can include a magnetic strip, radio-frequency identification, or other data storage components for storing the card number in a computer-readable format.

The card can be activated by initiating a subscription associated with card number, as illustrated 504. In particular, the subscription is for a period of time such as a day, several days, a week, a month, or a year, during which the card is considered active. In particular, the user can provide payment information, consumer information, selected subscription information, or any combination thereof. In addition, location permissions can be provided and stored either with the account on the remote server or on the card. Optionally, the subscription can be automatically renewed. For example, the consumer can establish a subscription which is automatically renewed at the end of each period.

Once the user supplies the consumer information and payment, the card number and associated activation information can be stored, as illustrated at 506. In particular, the card number and associated activation information can be stored at the remote server. The associated activation information can include information regarding the nature of the subscription, payment information, consumer information, location permissions, retail information, or any combination thereof. Optionally, location permissions can be stored on the card.

The card can be read at an ice machine, as illustrated at 508. For example, the ice machine card reader can provide a card number to a controller. The ice machine can access the activation information associated with card, as illustrated at 510. For example, the ice machine can communicate with a remote server using a communication circuitry to access the database at the remote server and retrieve portions of activation information. For example, the controller can retrieve information associated with whether the card is valid, active, and optionally, what location permissions are associated with the card.

Once it is determined that the card is valid, active or has permission to retrieve ice from the ice machine, the ice machine can dispense ice based on the activation information, as illustrated at 512. For example, once a valid active card is provided, the user can press a button implemented either as a separate physical button or as part of a touchscreen interface to activate a dispensing device. In example, ice is dispensed for a period of time after the button is pressed. Alternatively, a set amount of ice can be dispensed in response to pressing the button. In a further alternative, ice can be dispensed while the button is pressed, ceasing once the button is released. As such, dispensing ice is performed without debiting an account. Instead, ice is dispensed during the subscription period.

The ice machine can be provided to a retailer, club, marina, campground, park or other establishment. For example, the ice machine can be sold to the establishment. Card validation can be provided as a service subscription. In another example, the ice machine can be leased or rented. Validation services, including data connection services, can be included in the rent or lease rate or can be provided as an extra charge.

Figure 6:
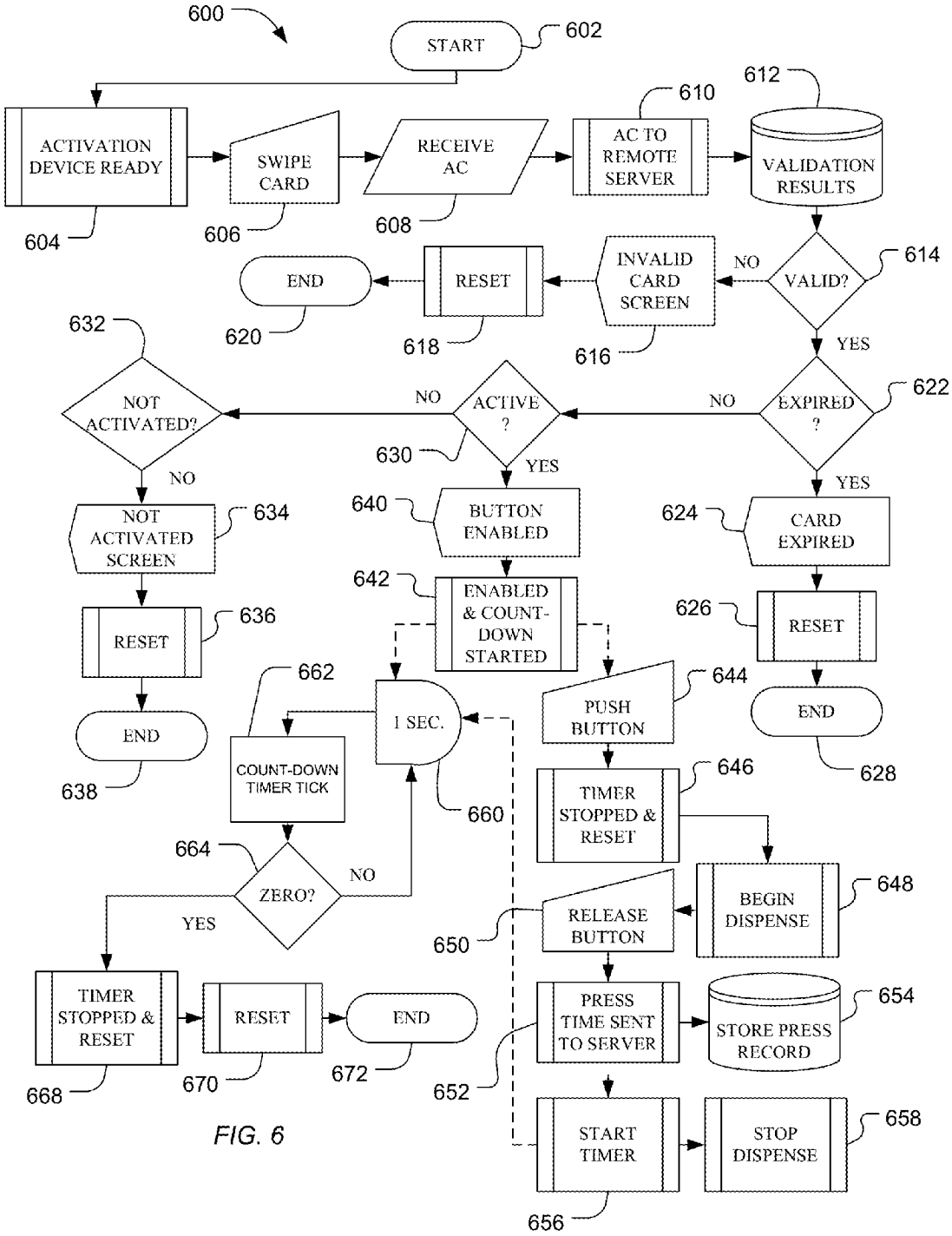

FIG. 6 illustrates an exemplary method 600 for dispensing ice. The method starts at 602. The ice machine awaits a card swipe, as illustrated at 604. When the consumer desires ice, the consumer can swipe the card, as illustrated at 606. As a result, an account code (AC) or card number is obtained, as illustrated at 608. The account code is sent to a remote server, as illustrated 610. The remote server returns validation results, such as a portion of the account information or results gleaned from the account information, as illustrated 612.

A controller of the ice machine can determine whether the card is valid, as illustrated at 614. When the card is not valid, a user interface is provided with an invalid card screen, as illustrated at 616, the ice machine is reset awaiting further transactions as illustrated at 618, and the process ends at 620.

When the card is valid, the controller determines whether the card has expired, as illustrated at 622. When the card has expired, an interface can be presented to the user indicating that the card has expired, as illustrated at 624. As a result, the ice machine can reset and await pending transactions, as illustrated at 626, and the process can end at 628.

When the card has not expired, the controller can determine whether the card is active, as illustrated 630. When the card is not active, the controller can determine based on the validation information whether the card has ever been activated, as illustrated at 632. When the card has never been activated, a user can be provided an interface display indicating that the card was not activated, as illustrated 634. The machine can reset and wait for further transactions, as illustrated 636, ending the process at 638.

When the card is active at 630, an interface can be provided to the user indicating the ice button is enabled, as illustrated at 640. For example, the interface can indicate that the ice button is enabled for a period of time, such as, for example, 10 seconds. As illustrated 642, when the button is enabled, the countdown timer is started. When the consumer pushes the ice button, as illustrated 644, the countdown timer stops, as illustrated at 646. The ice machine dispenses ice, as illustrated at 648, until the consumer releases the ice button, as illustrated 650. Optionally, button press time data can be sent to the remote server, as illustrated at 652, and the remote server can store a button press record, as illustrated at 654. Further, the countdown timer can be restarted, as illustrated 656, and the ice machine can stop dispensing ice, as illustrated 658.

While waiting for the ice button to be pressed, the counter can cycle through periodic intervals, for example, one second intervals, as illustrated 660. The countdown timer can decrement, as illustrated at 662. The controller can determine whether the timer has reached zero, as illustrated at 664. When the timer has not reached zero, the controller can decrement an additional second, as illustrated at 660, further counting down the timer. Once the timer has reached zero, the timer can be stopped and reset, as illustrated at 668. The ice machine can be reset to wait for additional transactions, as illustrated at 670 and the process can end at 672. In particular, a consumer can reswipe a card following the machine reset and restart the dispensing process.

Optionally, as part of the process to determine whether to dispense ice, the ice machine can determine whether the account associated with the card has permission to access a particular ice machine. For example, as illustrated in the method 700 of FIG. 7, a location setting can be provided to the machine, as illustrated at 702. In an example, the location setting can be set to a universal or public location setting, allowing those accounts authorized to access public ice machines to access and dispense ice. In another example, an ice machine can be designated as a private ice machine, limiting access to only those accounts associated with the ice machine.

In an example, a setting indicates whether the ice machine is to dispense ice to only those cards supplied by a group or retailer associated with the ice machine or whether the ice machine can dispense ice to a card provided by other groups or retailers. In another example, the settings may include a public option and private option, the private option further including an indicator or parameter associated with the group or retailer providing the card. For example, an ice machine implementing the private option can store one or more group numbers that can be compared to a group number associated with the card. The ice machine can dispense ice to cards associated with group numbers stored in conjunction with the private option. A group number associated with the card can be provided as part of the validation information.

Location permissions associated with an account or activation information can be provided to determine whether the account is provided with permissions to access public ice machines and can be provided to determine whether the account is provided with access to particular private ice machines. In a particular example, an ice machine can be provided with a particular private ice machine identifier, such as a unique number associated with the ice machine or a private set of ice machines. The account information can include, if permitted, a set of ice machine identifiers, allowing the consumer to access those ice machines associated with the particular ice machine identifier or set of ice machine identifiers. Alternatively, the activation information can include a Boolean indicator indicating whether the account has permission to access public ice machines and a Boolean indicator indicating whether the account can access private ice machines. The ice machines can thus, be set up in either public or private mode.

As illustrated at 704, the ice machine can receive activation data associated with the card. Such activation data can include location permission data associated with an account or card number. Alternatively, the permissions can be stored on the card. The ice machine can compare the location permissions from the activation data with the machine location settings, as illustrated at 706, to determine whether to dispense ice to the user of the card. As such, based at least in part on the comparison, ice can be dispensed, as illustrated at 708.

Figure 8:
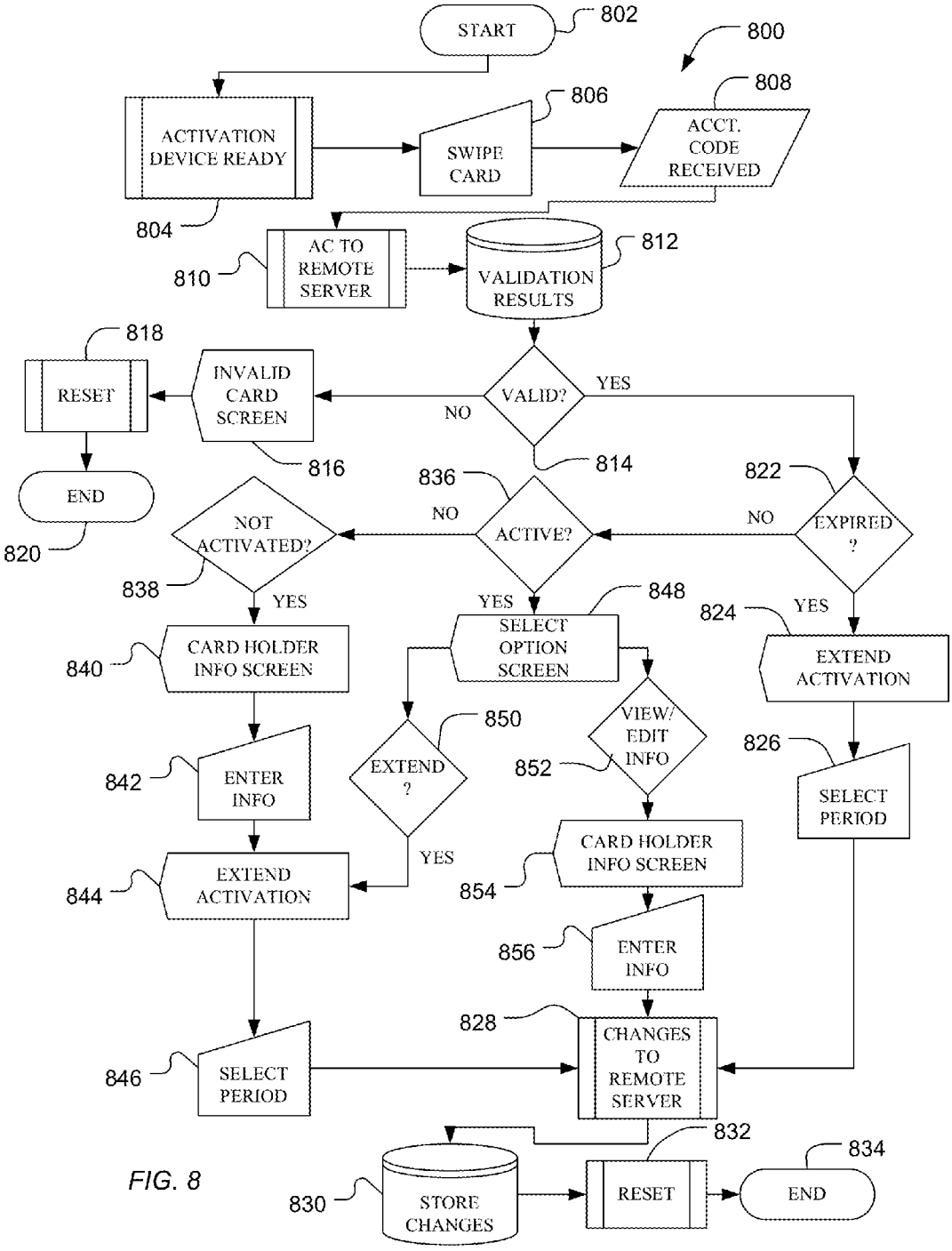
Figure 9:
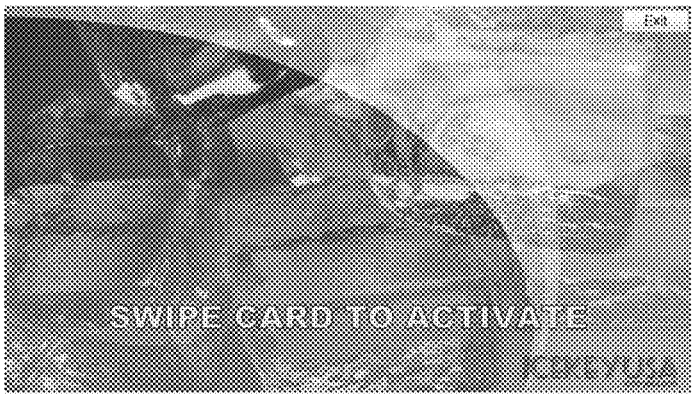
FIG. 9, FIG. 10, FIG. 11, FIG. 12, and FIG. 13 include illustrations of exemplary screen shots associated with an activation device.

To establish an account associated with a card, an activation device can be used. Alternatively, a card can be activated using an Internet interface acquiring similar information as discussed below. As illustrated in FIG. 8, a method 800 begins at 802. The activation device is ready for a card swipe, as illustrated at 804. An introduction or ready user interface, for example, as illustrated in FIG. 9, can be displayed to a user. In example, a user of the activation device, such as an employee of an establishment, swipes a card, as illustrated at 806, and the account code (AC) or card number associated with the card is obtained, as illustrated at 808.

Figure 13:
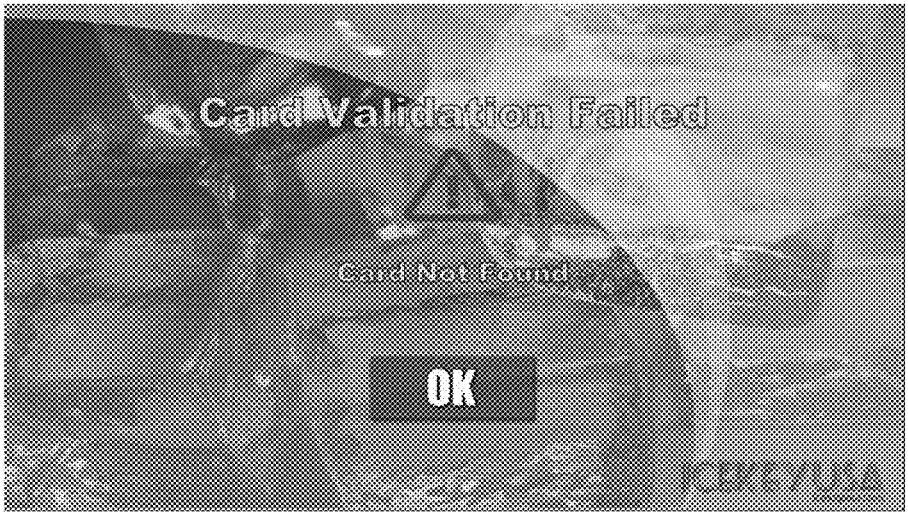

The account code or card number is sent to a remote server, as illustrated at 810 and, the remote server returns validation results, as illustrated at 812. The activation device can determine whether the card is valid, as illustrated at 814. When the card is not valid, an invalid card screen can be provided, as illustrated at 816. An exemplary invalid card screen as illustrated in FIG. 13. As a result, the activation device can reset and await new transactions, as illustrated at 818, and the process can end at 820.

Figure 12:
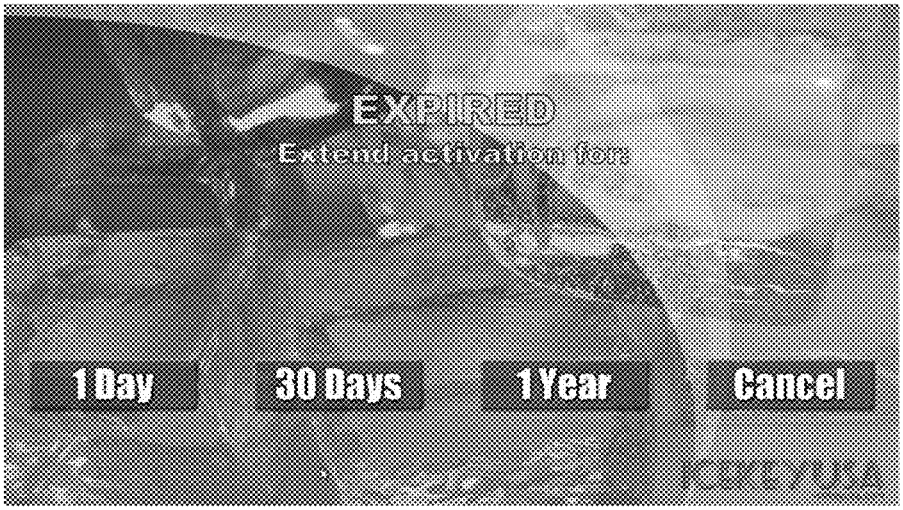

When the card is valid, the activation device can determine whether the card has expired, as illustrated at 822. When the card has expired, the activation screen can be provided to the user, as illustrated at 824. FIG. 12 includes an illustration of an exemplary extend activation screen. When a consumer decides to extend the activation, a user can select an activation time, as illustrated at 826. Account changes can be sent to the remote server, as illustrated at 828. The remote server can store the account changes, as illustrated at 830, and the activation device can reset and await further transactions, as illustrated at 832. The process can end, as illustrated at 834.

Figure 11:
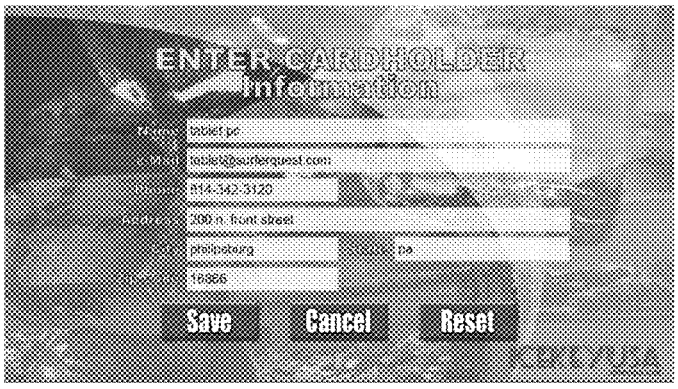

When the card has not expired, the activation device can determine whether the card is active, as illustrated at 836. When the card is not active, the activation device can determine whether the card has not been activated, e.g., when the card is new, as illustrated at 838. When the card has not been activated, the consumer information screen can be provided, as illustrated 840. An exemplary consumer information screen is illustrated in FIG. 11. Alternatively, additional screens or user interfaces can be provided for payment information, automatics re-subscription information, location permissions, or other data entry.

Returning to FIG. 8, a user can enter the account holder's information, as illustrated at 842, and an extend activation screen can be provided to the user, as illustrated at 844. The user can select an activation period, as illustrated at 846. Account changes can be sent to the remote server, as illustrated at 828. The remote server can store the account changes, as illustrated at 830, and the activation device can reset and await additional transactions, as illustrated at 832.

Figure 10:
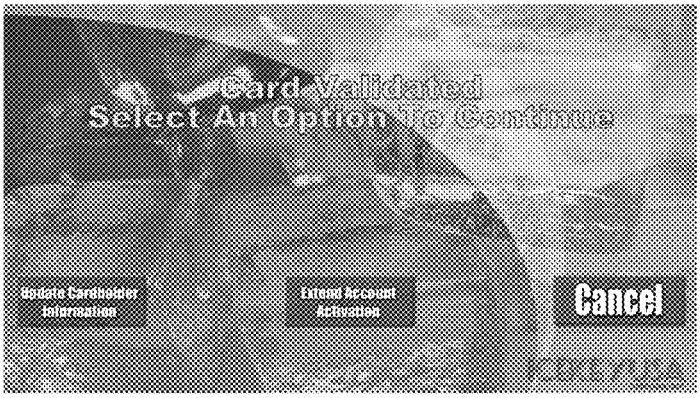

When the card is active, a select an option screen, as illustrated at 848, can be provided to the user. For example, FIG. 10 includes an illustration of exemplary select an option screen. When the user selects extending activation, as illustrated 850, the extend activation screen can be provided, as illustrated 844, and a user can select an activation time period, as illustrated at 846.

When the view/edit account information is selected, as illustrated at 852, the consumer information screen can be provided, as illustrated at 854. The user can enter account information associated with the account holder, as illustrated at 856, and the changes can be sent to the remote server, as illustrated at 828.

In the event a card is lost, the activation station can provide options to cancel lost cards and a user can activate a new card. For example, the activation device can provide an interface to find an account based on consumer information and can provide an interface to cancel the card associated with the account. In an example, the activation can provide an option to associate a new card with the consumer information. In another example, the activation device can follow a procedure as described in relation to FIG. 8 to activate and validate a new card.

In a further example, the activation device can be automated to permit consumers to enter information to establish an account and the activation device can dispense a validated and activated card following entry of account information.

In a first aspect, an ice machine includes an insulated compartment to store ice, a dispenser having access to the insulated compartment to dispense ice from the insulated compartment, a card reader, and a controller in communication with the card reader and the dispenser. The controller stores permission settings including a public setting and a private setting. The controller is to receive a card number associated with a card from the card reader. The controller is to determine whether to initiate ice dispensing using the dispenser based on the card number, the public setting and the private setting.

In an example of the first aspect, the ice machine further includes a communication circuitry, the controller in communication with the communication circuitry. For example, the controller is to communicate the card number to a remote server using the communication circuitry and is to receive validation information from the remote server, wherein determining based on the card number includes determining based on the validation information. In an additional example, the validation information includes location permission data associated with the card. The controller is to compare the location permission data with the public setting or the private setting.

In an additional example of the first aspect and the above examples, the controller is to receive a group number associated with the card from the card reader, the controller to compare the group number to the private setting.

In a further example of the first aspect and the above examples, the ice machine further includes an ice maker to provide ice to the insulated compartment.

In another example of the first aspect and the above examples, the ice machine further includes a button in communication with the controller, the controller to initiate ice dispensing in response to activation of the button following the determining. For example, ice can be dispensed for a set period of time following activation of the button. In another example, ice can be dispensed while the button is activated.

In an example of the first aspect and the above examples, the controlled is to initiate the dispensing without debiting a card account associated with the card number.

In a second aspect, a system includes an ice machine and a remote server. The ice machine includes an insulated compartment to store ice, a dispenser having access to the insulated compartment to dispense ice from the insulated compartment, a card reader, a communication circuitry, and a controller in communication with the card reader, the communication circuitry, and the dispenser. The controller stores permission settings including a public setting and a private setting. The controller is to receive a card number from the card reader. The controller is to provide the card number to a remote server and is to receive validation information from the remote server using the communication circuitry. The controller is to determine whether to initiate ice dispensing using the dispenser based on the validation information, the public setting, or the private setting. The remote server includes data storage associating the card number and the validation information. The system can include a plurality of the ice machines.

In an example of the second aspect and the above examples, the system further includes an activation device comprising a card reader and a communication circuitry. The activation device is to receive a card number using the card reader and to provide the card number and activation information to the remote server using the communication circuitry.

In an additional example of the second aspect and the above examples, the ice machine further includes an ice maker to provide ice to the insulated compartment.

In another example of the second aspect and the above examples, the ice machine further includes a button in communication with the controller, the controller to initiate ice dispensing in response to activation of the button following the determining. For example, ice can be dispensed for a set period of time following activation of the button. In an additional example, ice can be dispensed while the button is activated.

In a further example of the second aspect and the above examples, the controlled is to initiate the dispensing without debiting a card account associated with the card number.

In a third aspect, a method of dispensing ice includes receiving permission settings at an ice machine, the permission settings including a public setting and a private setting; receiving an account code using a card reader at the ice machine; determining based on the account code, the public setting, or the private setting whether an account associated with the account code has permission to access the ice machine; and dispensing ice based on the determining.

In an example of the third aspect, the method further includes communicating the account code to a remote server and receiving validation information from the remote server. For example, determining includes determining whether an account associated with the account code is valid and active. In another example, the validation information can include permission data, wherein determining includes comparing the permission data to the permission settings.

In a further example of the third aspect and the above examples, the method further includes receiving permission data stored on a card associated with the account code from the card reader, wherein determining includes comparing the permission data to the permission settings. In an additional example of the third aspect, dispensing ice is performed without debiting an account.

In a fourth aspect, an ice machine includes an insulated compartment to store ice, a dispenser having access to the insulated compartment to dispense ice from the insulated compartment, a card reader, a communication circuitry to communicate with a remote device, and a controller in communication with the card reader, the dispenser, and the communication circuitry. The controller is to receive a card number from the card reader. The controller is to determine whether the card number is valid and active by communicating with the remote device using the communication circuitry. The controller is to initiate ice dispensing using the dispenser in response to the determining.

In an example of the fourth aspect, the controller is configured to receive a location indicator associated with the card number from the remote device, the controller to compare the location indicator to permission settings stored at the controller.

In another example of the fourth aspect and the above examples, the ice machine further includes an ice maker to provide ice to the insulated compartment.

In an additional example of the fourth aspect and the above examples, the ice machine further includes a button in communication with the controller, the controller to initiate ice dispensing in response to activation of the button following the determining. For example, ice can be dispensed for a set period of time following activation of the button. In another example, ice can be dispensed while the button is activated.

In a further example of the fourth aspect and the above examples, the controlled is to initiate the dispensing without debiting a card account associated with the card number.

In a fifth aspect, a system includes an ice machine and a remote server. The ice machine includes an insulated compartment to store ice, a dispenser having access to the insulated compartment to dispense ice from the insulated compartment, a card reader, a communication circuitry to communicate with a remote device, and a controller in communication with the card reader, the dispenser, and the communication circuitry. The controller is to receive a card number from the card reader. The controller is to determine whether the card number is valid and active by communicating with the remote device using the communication circuitry. The controller is to initiate ice dispensing using the dispenser in response to the determining. The remote server includes data storage associating the card number and the validation information. The system can include a plurality of the ice machines.

In an example of the fifth aspect, the system further includes an activation device comprising a card reader and a communication circuitry, the activation device to receive a card number using the card reader and to provide the card number and activation information to the remote server using the communication circuitry.

In another example of the fifth aspect and the above examples, the ice machine further includes an ice maker to provide ice to the insulated compartment.

In an additional example of the fifth aspect and the above examples, the ice machine further includes a button in communication with the controller, the controller to initiate ice dispensing in response to activation of the button following the determining. For example, ice can be dispensed for a set period of time following activation of the button. In another example, ice can be dispensed while the button is activated.

In a further example of the fifth aspect and the above examples, the controlled is to initiate the dispensing without debiting a card account associated with the card number.

In a sixth aspect, a method of dispensing ice includes receiving consumer information associated with a card number; establishing an account associated with the card number, the account defining a period of a subscription; receiving the card number from an ice machine; and providing validation data associated with the card number, the ice machine to dispense ice when the validation data indicates an account is valid and has not expired, the ice machine to dispense ice without debiting an account.

In a seventh aspect, a method of dispensing ice includes activating a card having a card number for a subscription period in response to receiving consumer information and dispensing ice in response to receiving the card number during the subscription period.

In an example of the seventh aspect, the method further includes automatically reactivating the card at the end of the subscription period for a renewal period.

While the above embodiments relate to ice machines, systems including ice machines, and methods for dispensing ice, aspects of the machines, systems and methods can be extended to other self-sufficient machines that dispense a product produced in bulk at the machine, in contrast to individually packaged products.

Parts of the above described methods can be implemented in computer-implemented instructions. Such computer-implemented instructions can instruct a processor to perform the functions of the method and can be stored on computer-readable media in a tangible and intransient form. For example, the computer-implemented instructions can be stored in a tangible memory device accessible to processors and other circuitry.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An ice machine comprising:

an insulated compartment to store ice;

a dispenser having access to the insulated compartment to dispense ice from the insulated compartment;

a card reader; and a controller in communication with the card reader and the dispenser, the controller storing permission settings including a setting selectable between a public option and a private option, the controller to receive a card number associated with a card from the card reader, the controller to determine whether to initiate ice dispensing using the dispenser based on the card number and the select public or private option of the setting, wherein the public option permits dispensing to card numbers associated with all groups and the private option limits dispensing to card numbers associated with a select group, wherein the select group is associated with a private or public retailer, club, venue, association, union, or organization, wherein the card number associated with the select group can be used at other ice machines with the public option selected to dispense ice, and wherein the controller is to initiate the dispensing without debiting a card account associated with the card number.

2. The ice machine of claim 1, further comprising a communication circuitry, the controller in communication with the communication circuitry.

3. The ice machine of claim 2, wherein the controller is to communicate the card number to a remote server using the communication circuitry and is to receive validation information from the remote server, wherein determining based on the card number includes determining based on the validation information.

4. The ice machine of claim 3, wherein the validation information includes location permission data associated with the card, the controller to compare the location permission data with the public or private option of the setting.

5. The ice machine of claim 1, wherein the controller is to receive a group number associated with the card from the card reader, the controller to compare the group number to the private option when selected.

6. The ice machine of claim 1, further comprising an ice maker to provide ice to the insulated compartment.

7. The ice machine of claim 1, further comprising a button in communication with the controller, the controller to initiate ice dispensing in response to activation of the button following the determining.

8. The ice machine of claim 7, wherein ice is dispensed for a set period of time following activation of the button.

9. The ice machine of claim 7, wherein ice is dispensed while the button is activated.

10. A system comprising:

an ice machine, the ice machine comprising:

an insulated compartment to store ice;

a dispenser having access to the insulated compartment to dispense ice from the insulated compartment;

a card reader;

a communication circuitry; and a controller in communication with the card reader, the communication circuitry, and the dispenser, the controller storing permission settings including a setting selectable between a public option and a private option, the controller to receive a card number from the card reader, the controller to provide the card number to a remote server and to receive validation information from the remote server using the communication circuitry, the controller to determine whether to initiate ice dispensing using the dispenser based on the validation information and the select public or private option of the setting, wherein the public option permits dispensing to card numbers associated with all groups and the private option limits dispensing to card numbers associated with a select group, wherein the select group is associated with a private or public retailer, club, venue, association, union, or organization, wherein the card number associated with the select group can be used at other ice machines within the system with the public option selected to dispense ice, and wherein the controller is to initiate the dispensing without debiting a card account associated with the card number; and the remote server comprising data storage associating the card number and the validation information.

11. The system of claim 10, further comprising an activation device comprising a card reader and a communication circuitry, the activation device to receive a card number using the card reader and to provide the card number and activation information to the remote server using the communication circuitry.

12. The system of claim 10, wherein the ice machine further includes an ice maker to provide ice to the insulated compartment.

13. The system of claim 10, wherein the ice machine further includes a button in communication with the controller, the controller to initiate ice dispensing in response to activation of the button following the determining.

14. The ice machine of claim 13, wherein ice is dispensed for a set period of time following activation of the button.

15. The ice machine of claim 13, wherein ice is dispensed while the button is activated.

16. A method of dispensing ice, the method comprising:

receiving permission settings at an ice machine, the permission settings including a setting selectable between a public option and a private option;

receiving an account code using a card reader at the ice machine;

determining based on the account code and the select public or private option of the setting whether an account associated with the account code has permission to access the ice machine, wherein the public option permits dispensing to accounts associated with all groups and the private option limits dispensing to accounts associated with a select group, wherein the select group is associated with a private or public retailer, club, venue, association, union, or organization, wherein the card number associated with the select group can be used at other ice machines with the public option selected to dispense ice; and dispensing ice based on the determining without debiting a card account associated with the card number.

17. The method of claim 16, further comprising communicating the account code to a remote server and receiving validation information from the remote server.

18. The method of claim 17, wherein determining includes determining whether an account associated with the account code is valid and active.

19. The method of claim 17, wherein the validation information includes permission data, wherein determining includes comparing the permission data to the permission settings.

20. The method of claim 16, further comprising receiving permission data stored on a card associated with the account code from the card reader, wherein determining includes comparing the permission data to the permission settings.

* * * * *